US006280347B1

(12) United States Patent
Herber

(10) Patent No.: US 6,280,347 B1
(45) Date of Patent: Aug. 28, 2001

(54) METHOD AND MEANS FOR SELECTIVELY POSITIONING GOLF CLUB SHAFT FLEX POINT

(76) Inventor: Paul J. Herber, 2445 Cades Way, Vista, CA (US) 92083

( * ) Notice: Subject to any disclaimer, the term of this patent is extended or adjusted under 35 U.S.C. 154(b) by 0 days.

(21) Appl. No.: 09/384,696

(22) Filed: Aug. 26, 1999

(51) Int. Cl.[7] ..... A63B 53/10
(52) U.S. Cl. ..... 473/316; 473/289
(58) Field of Search ..... 473/256, 289, 473/316, 318, 319

(56) References Cited

U.S. PATENT DOCUMENTS 4,725,060 * 2/1988 Iwanaga .
5,297,791 * 3/1994 Negishi .
5,496,028 * 3/1996 Chien .
5,551,691 * 9/1996 Harada et al. .
5,755,826 * 5/1998 Beach et al. .
5,759,112 * 6/1998 Morell et al. .
5,882,268 * 3/1999 McIntosh et al. .
5,938,542 * 8/1999 Hoffmeyer .
6,024,651 * 2/2000 Cheng .

* cited by examiner

*Primary Examiner*—William M. Pierce
(74) *Attorney, Agent, or Firm*—George J. Netter

(57) ABSTRACT

A golf club shaft (12) is provided with ringlike shaft stiffening bodies (22) at a given location along the shaft in order to locate the shaft flex point appropriately for a particular individual. Each stiffening body (22) consists of a quantity of an epoxy and glass fibers mixture which is molded about the shaft (12) and sets up to a rigid condition.

17 Claims, 2 Drawing Sheets

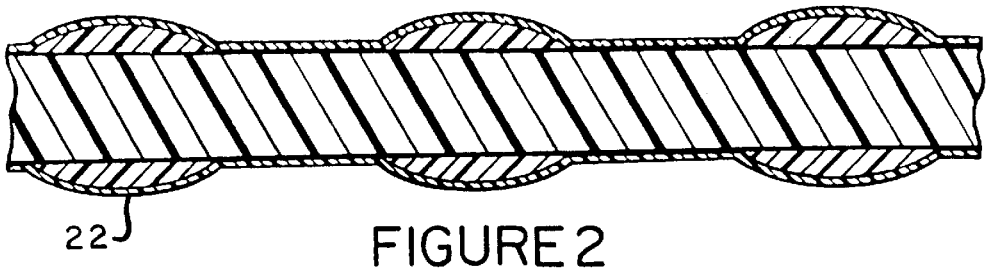
FIGURE 2
FIG. 3A
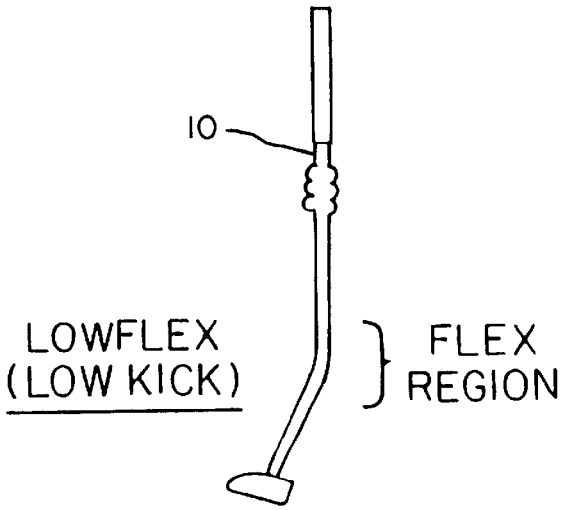
FIG. 3B
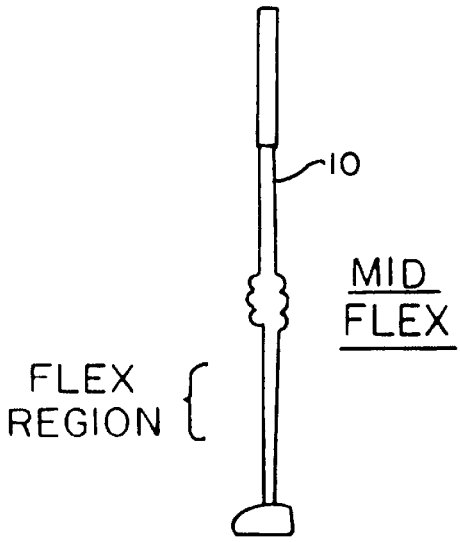
FIG. 3C
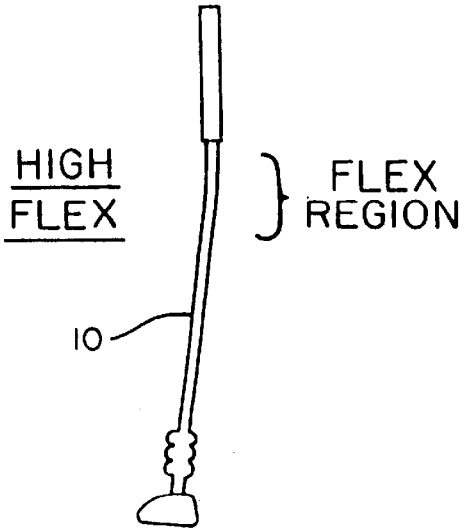

METHOD AND MEANS FOR SELECTIVELY POSITIONING GOLF CLUB SHAFT FLEX POINT

BACKGROUND

1. Background of the Invention

The present invention relates generally to a golf club, and, more particularly to means and method of selectively locating the flex point, and thus the so-called kick-point, of a golf club shaft.

2. Description of Related Art

A satisfactory golf club for a given individual requires attention being paid to a number of different factors such as physical attributes of the individual, average speed of individual's golf swing, flexibility of material from which shaft is made, necessary strength of shaft to withstand torquing during use over a reasonable period of time. These factors frequently interact with one another producing unexpected or undesirable results. For example, a shaft made of a particular material might require a relatively small cross-sectional dimension for desired flexibility, but this in turn could result in a shaft having insufficient strength to insure against breakage. On the other hand, although thickening the shaft cross-section improves strength, this at the same time results in an undesirable lessening of flexibility. From the human side of the equation, children, some women and elderly golfers have relatively slow "swings" making it desirable to substantially increase shaft flexibility with an aim of increasing hitting distance. Club shafts at the present time are typically made from either steel or a graphite composition, which materials not only have different densities but possess different strengths and flexibility characteristics resulting in overall club design parameters and limitations that are different.

It is, therefore, a desired and advantageous feature of a golf club for use by individuals having "slow" swings that it provide an optimal "kick" of the clubhead improving hitting distance without sacrificing other desired or required physical attributes of the club.

SUMMARY OF THE INVENTION

It is, therefore, a primary aim and object of the present invention to provide means and method for selectively positioning the point of maximum flexibility of a golf club shaft over a broad range.

Another object is the provision of a golf club shaft as in the first object in which a stiffening member is secured to the shaft at a predetermined location along the shaft .

Yet another object is the provision of golf club shaft in accordance with the preceding objects in which the stiffening member is molded onto the underlying shaft.

Another object is the provision of stiffening member including at least one annulus of an epoxy/graphite mixture.

A still further object of the invention is the provision as in the immediately previous object of a stiffening member preferably including a pkurality of spaced-apart epoxy/graphite rings located immediately adjacent the club grip to lower the kick point of the shaft and produce a ball flight of a relatively high trajectory as would normally be expected from a low speed swing.

BRIEF DESCRIPTION OF THE DRAWINGS

These and other objects and advantages of the present invention will become more readily apparent upon reference to the following detailed description and upon reviewing the attached drawings, in which:

FIG. 2 is an enlarge d sectional view of a golf club shaft with shaft stiffening means according to the invention; and FIGS. 3A, 3B and 3C depict, respectively, application of the invention to provide low, mid and high shaft flex points.

DESCRIPTION OF PREFERRED EMBODIMENT

Figure 1:
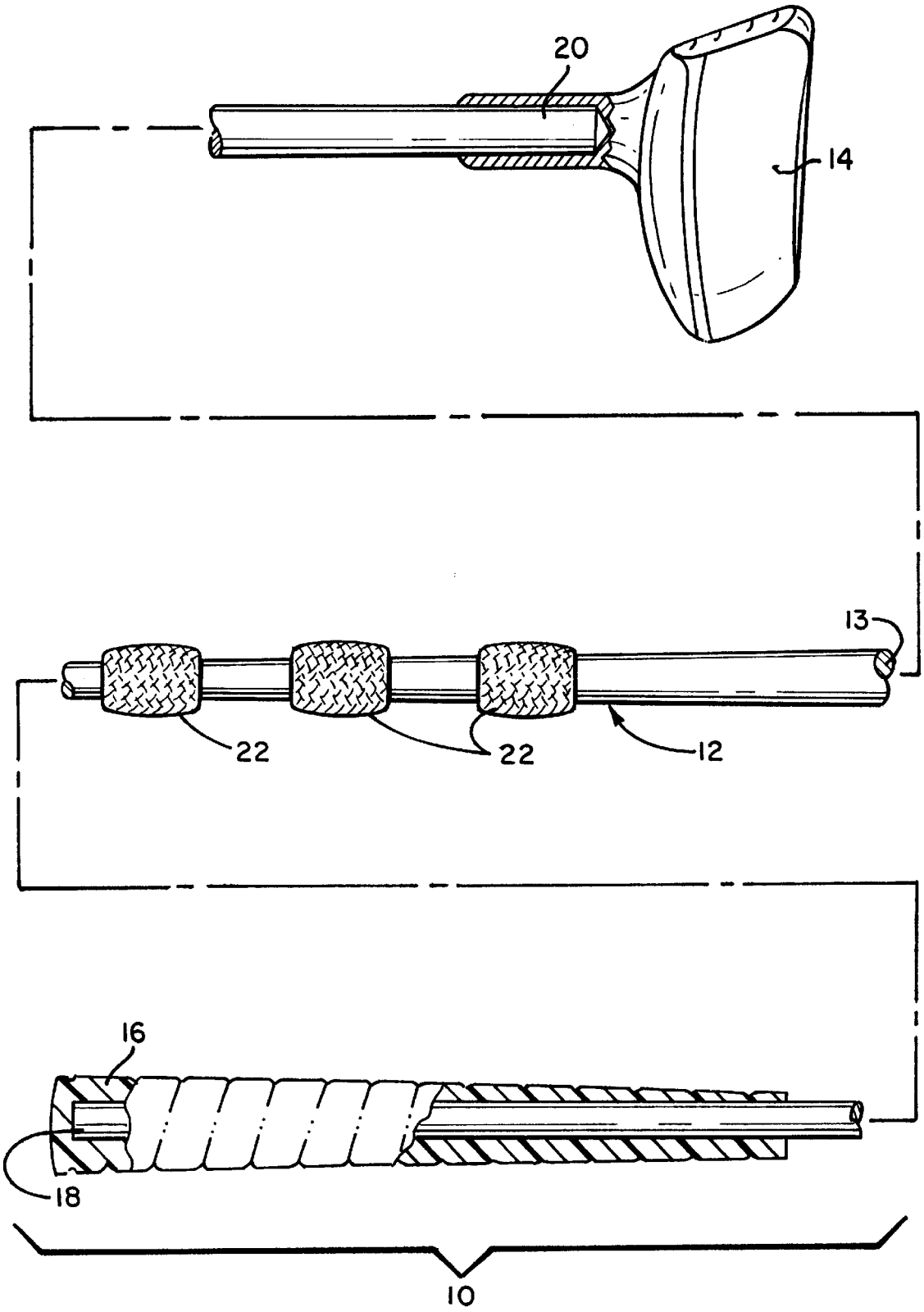
FIG. 1 is an elevational, partially sectional view of a golf club modified in accordance with the present invention.

With reference now to the drawing and particularly to FIG. 1, there is shown a golf club 10 of the so-called "wood" category including a shaft means 12, a head 14 which contacts the game ball during use, and a grip 16 which, as the name implies, is held by the hands during swinging. The shaft means 12 includes a shaft base 13 which is solid and preferably constructed of glass fibers or other sufficiently strong material (e.g., so-called graphite shaft). Optionally, the shaft base may be constructed of steel and be of an overall hollow tubular formation.

The preferred shaft base has a generally circular cross-section of a diameter that may be constant over a certain portion of its length and taper over other parts of its length. Preferably, however, the shaft base tapers uniformly from a maximum cross-section at the the grip end 18 to a minimum diameter portion 20 that is received within and secured to the head 14. Adjacent the grip 18 there are provided at least one, but preferably a plurality of enlarged generally ringlike bodies 22 spaced from one another along the shaft base. The bodies 22 are received about the shaft base and adheringly secured to the outer surface of the shaft base 13 in a unitary relationship. The outermost suface of the bodies is smooth and uniformly curved.

Turning now to FIG. 2, the bodies 22 shown in section are seen to be of a solid consistency free of openings or vacuoles and adhered to the outer surface of the shaft. Although other materials may be found advantageous for this purpose, preferably the bodies 22 are constructed of an epoxy adhesive uniformly intermixed with graphite particles. The bodies 22 provide additional stiffening to the club against transverse bending or flexing in the shaft region underlying the bodies. Stiffening the shaft closely adjacent the grip 16 has been found to lower the shaft flex point on the shaft and, in that manner, to increase the clubhead speed in the ball striking portion of the swing path without disturbing feel or otherwise materially interfering with the swing. This enables selecting a shaft base 13 of generally desirable physical characteristics and improving the club head kick even when swung at a relatively low speed.

One method of making the stiffening bodies 22 includes locating an appropriately formed breakaway mold at a desired position on the shaft base 13 (e.g., immediately adjacent the grip 16). Next, a viscous, semiliquid mixture of an epoxy adhesive and powdered graphite is applied to the mold and allowed to set up into a hardened body 22 that is securely adhered to the peripheral surface of the shaft base. Finally, the mold is removed from the shaft base and, optionally, a protective or decorative coating 24 can be applied to the shaft base and over the hardened bodies 22.

Although the location of the shaft stiffening bodies 22 adjacent the club grip as shown in FIGS. 1 and 3A is the commonly employed application of the invention, in other cases it may be desirable to have the flex point of a club shaft located in the mid-section of the shaft, or even higher. These arrangements are depicted in FIGS. 3B and 3C, respectively, with the resulting flex points shown for the particular location of the stiffening bodies. For purposes of illustration, the club shafts are shown bent or flexed about their respective flex points as would be produced during swinging.

In accordance with the practice of the described invention, there is provided a means and method for stiffening a golf club at any point along the club shaft so as to produce a corresponding relocation of the maximum flex point of the shaft during swinging. This is accomplished easily, relatively inexpensively and without significantly changing the weight characteristics of the club. More particularly, the invention is contemplated for use on clubs which are to be used by expected "slow" swinging individuals such as seniors or juniors, for example, and which will increase reliability of ball contact and clubhead speed in the ball striking region resulting in greater length and accuracy.

Although the invention has been described in connection with a preferred embodiment, it is to be understood that those skilled in the appertaining art may contemplate effecting changes that are within the spirit of the invention as described and claimed.

What is claimed is:

1. A golf club shaft means having a grip end portion head end portion, comprising:

an elongated shaft base having a generally cylindrical transverse cross-section; and radially outwardly extending body means received onto and unitarily secured to the shaft base for stiffening the shaft base at the securement, said body means including a molded member adhesively secured to the shaft base consisting of an epoxy and powdered graphite.

2. A golf club shaft means as in claim 1, in which said body means includes a molded member adhesively secured to the shaft base over a limited extent of the shaft base.

3. A golf club shaft means as in claim 1, in which said body means is constructed of a material including epoxy.

4. A golf club shaft means as in claim 1, in which said body means is constructed of a material including graphite.

5. A golf club shaft means as in claim 1, in which said body means is constructed of a material including an epoxy adhesive and powdered graphite.

6. A golf club shaft means as in claim 1, in which the body means includes a plurality of annular-shaped ridges received about the shaft base arranged in spaced apart relation from one another along the shaft base.

7. A golf club shaft as in claim 6, in which adjacent ridges are separated from one another by a continuous space substantially free from body means material.

8. A golf club shaft as in claim 1, in which an outer layer encloses the body means and shaft base.

9. A golf club shaft as in claim 1, in which the body means has a uniformly curved outwardly facing surface.

10. A golf club shaft as in claim 1, in which the body means is located on the shaft base closely adjacent the grip end portion.

11. A golf club shaft as in claim 1, in which the body means is located on the shaft base generally midway between the grip end portion and head end portion.

12. A golf club shaft as in claim 1, in which the body means is located on the shaft base closer to the head end portion than the grip end portion.

13. A golf club shaft means with predetermined maximum flex point, comprising:

an elongated shaft base tapered with respect to a longitudinal axis, said base having a club end portion and an opposite grip end portion; and three spaced-apart annular body means adhesively adhered to the shaft base adjacent the grip end portion, each said body means being formed from a material including intermixed epoxy and graphite particles.

14. A golf club shaft means as in claim 13, in which the shaft base is constructed of glass fibers.

15. A golf club shaft means as in claim 13, in which the body means are molded and symmetrically arranged about the shaft base.

16. A method of presetting the flex point of a golf club having an elongated shaft base, a grip on one end of the shaft base and a clubhead on the other shaft base end, comprising the steps of:

preparing a quantity of a viscous semiliquid adhesive material;

applying adhesive material quantity in a symmetric configuration about a preselected region of the shaft base; and allowing the adhesive to set up to a rigid condition secured to the shaft base.

17. A method as in claim 16, including the further step of applying a coating over the set up adhesive and shaft base.

* * * * *

UNITED STATES PATENT AND TRADEMARK OFFICE

CERTIFICATE OF CORRECTION

PATENT NO. : 6,280,347 B1
DATED : August 28, 2001
INVENTOR(S) : Paul Herber

It is certified that error appears in the above-identified patent and that said Letters Patent is hereby corrected as shown below:

Column 2,
Line 5, delete "enlarge d" and insert -- enlarged --.

Column 3,
Line 22, cancel beginning with "1. A golf club shaft" to and including "powdered graphite."
and insert the following claim:

-- 1. A golf club shaft means having a grip end portion and a head end portion, comprising:

an elongated shaft base having a generally cylindrical transverse cross-section; and radially outwardly extending body means received onto and unitarily secured to the shaft base for stiffening the shaft base at the securement, said body means including a molded member adhesively secured to the shaft base consisting of an epoxy and powdered graphite. --

In Column 3, lines 32-41 and Column 4, lines 6-7, and 30-43, delete in their entirety.

Signed and Sealed this

Fourteenth Day of May, 2002

*Attest:*

*Attesting Officer*

JAMES E. ROGAN
*Director of the United States Patent and Trademark Office*